US005213040A

United States Patent [19]

Mihori et al.

[11] Patent Number: 5,213,040

[45] Date of Patent: May 25, 1993

[54] AUTOMATIC CLEANING APPARATUS FOR GRAVURE PLATE CYLINDERS

[75] Inventors: Tomoyasu Mihori; Toshiya Saeki; Sadayoshi Naito; Masaichi Iiboshi, all of Zama; Hiroki Nakamura, Funabashi, all of Japan

[73] Assignee: Toshiba Kikai Kabushiki Kaisha, Tokyo, Japan

[21] Appl. No.: 802,127

[22] Filed: Dec. 3, 1991

[51] Int. Cl.[5] ..... B41F 35/00

[52] U.S. Cl. ..... 101/424; 101/425

[58] Field of Search ..... 101/424, 425, 423; 15/256.5, 256.51, 256.53, 256.52

[56] References Cited

U.S. PATENT DOCUMENTS

| | | | |
|---|---|---|---|
| 2,704,026 | 3/1955 | Rogge et al. | 101/425 |
| 3,227,078 | 1/1966 | Johnson | 101/425 |
| 3,295,442 | 1/1967 | Allen | 101/425 |
| 3,688,337 | 9/1972 | Noda | 15/256.53 |
| 3,740,789 | 6/1973 | Ticknor | 15/256.53 |
| 4,540,445 | 9/1985 | Burns, Jr. | 101/424 |
| 4,699,668 | 10/1987 | Burns, Jr. et al. | 101/424 |
| 4,953,463 | 9/1990 | Hara | 101/425 |

FOREIGN PATENT DOCUMENTS

| | | | |
|---|---|---|---|
| 0652827 | 11/1962 | Canada | 101/425 |

OTHER PUBLICATIONS

Fathergill et al. "Printing System Having a Hot Roll Fuser with a Scraping Blade Cleaner", B579116 U.S. Published Patent Application Feb. 3, 1976.

*Primary Examiner*—Edgar S. Burr
*Assistant Examiner*—Anthony H. Nguyen
*Attorney, Agent, or Firm*—Koda and Androlia

[57] ABSTRACT

An automatic cleaning apparatus for a gravure plate cylinder comprises a carriage having a spatula capable of contacting the outer cylindrical surface of a gravure plate cylinder and a solvent sprinkling pipe for sprinkling a cleaning solvent on the outer cylindrical surface of the gravure plate cylinder which is rotated about its axis during the cleaning operation. The carriage is moved in a direction parallel to the gravure plate cylinder by rotating a screw bar, and the spatula of the carriage is pressed against the gravure plate cylinder by a pressure shaft connected to an actuator.

1 Claim, 2 Drawing Sheets

AUTOMATIC CLEANING APPARATUS FOR GRAVURE PLATE CYLINDERS

BACKGROUND OF THE INVENTION

The present invention relates to an automatic cleaning apparatus for gravure plate cylinders.

Traditionally, the cleaning of used gravure plate cylinders has been performed manually. That is, waste cloths are soaked with a cleaning solvent, and the ink remaining on the used gravure plate cylinders is wiped off by using the waste cloths with human hands.

The cleaning of the used gravure plate cylinders has been thus performed manually, but in the case of manually cleaning the used gravure plate cylinder, much labor and time are required, whereby the productivity is decreased. In addition, as the cleaning solvent generally contains hydrocarbons, it is not desirable for operators to wipe directly with the soaked waste cloths from the viewpoint of working safety and hygiene.

SUMMARY OF THE INVENTION

It is therefore an object of the present invention to provide an automatic cleaning apparatus for gravure plate cylinders which can automatically clean the gravure plate cylinders.

According to the present invention, there is provided an automatic cleaning apparatus for gravure plate cylinders comprising: a carriage having a spatula capable of being placed in contact with the outer cylindrical surface of a gravure plate cylinder supported to be rotatable about the cylindrical axis thereof; means for rotating the gravure plate cylinder; moving means for moving the carriage in a direction parallel to the cylindrical axis of the gravure plate cylinder; pressing means for pressing the spatula against the outer cylindrical surface of the gravure plate cylinder; and sprinkling means for sprinkling a cleaning solvent on the cylindrical surface of the gravure plate cylinders.

According to the present invention, the cleaning solvent is sprinkled on the gravure plate cylinder in advance by the sprinkling means, the spatula of the carriage is pressed against the gravure plate cylinder by the pressing means, and the carriage is moved in the direction parallel to the gravure plate cylinder by the moving means while the gravure plate cylinder is rotated, whereby the ink remaining on the gravure plate cylinder is dissolved and scraped off the gravure plate cylinder.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE INVENTION

An automatic cleaning apparatus for gravure plate cylinders of the present invention will be described below with reference to FIGS. 1 and 2.

Figure 1:
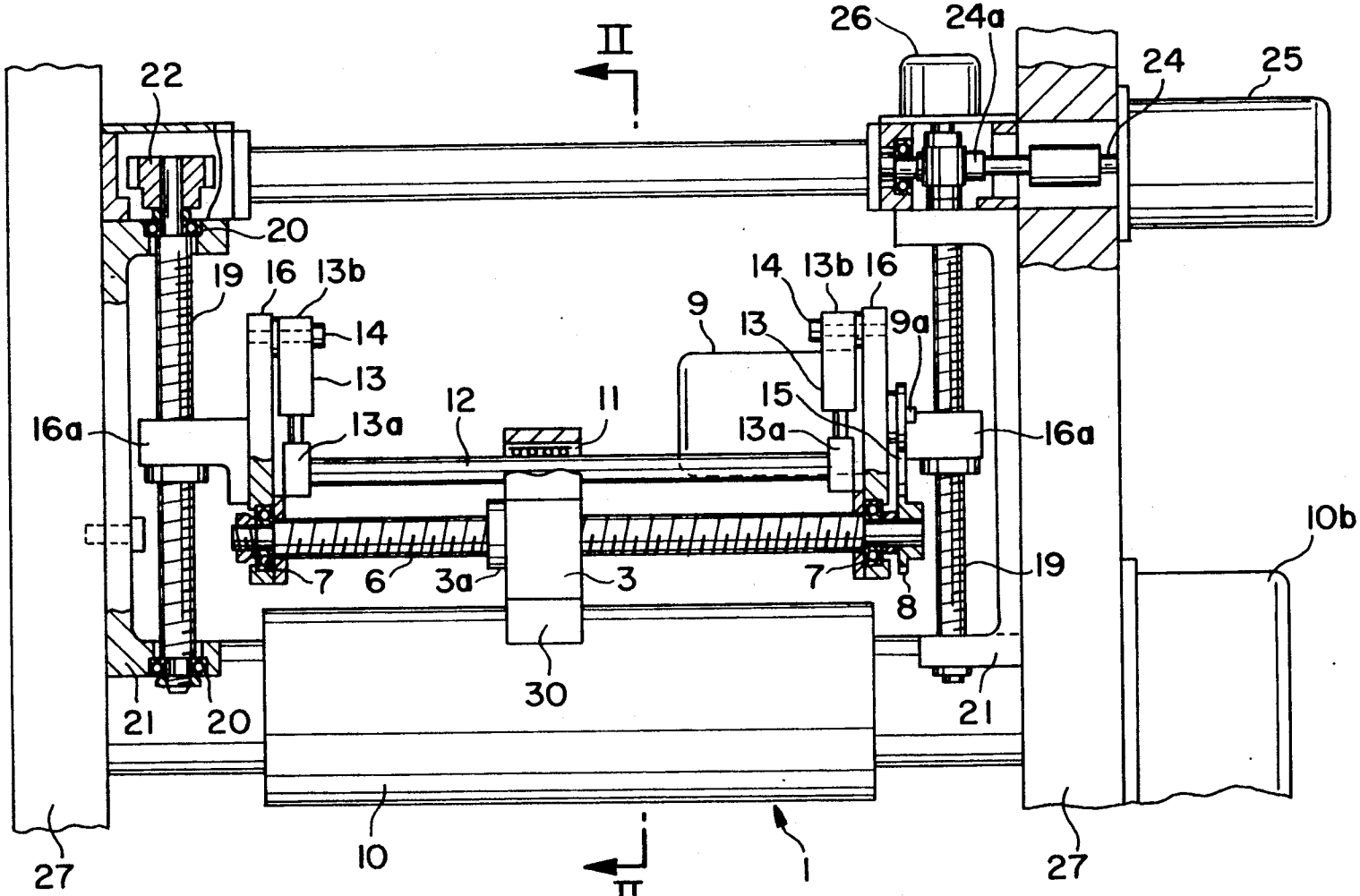
FIG. 1 is a front view showing an automatic cleaning apparatus for gravure plate cylinders according to an embodiment of the present invention.
Figure 2:
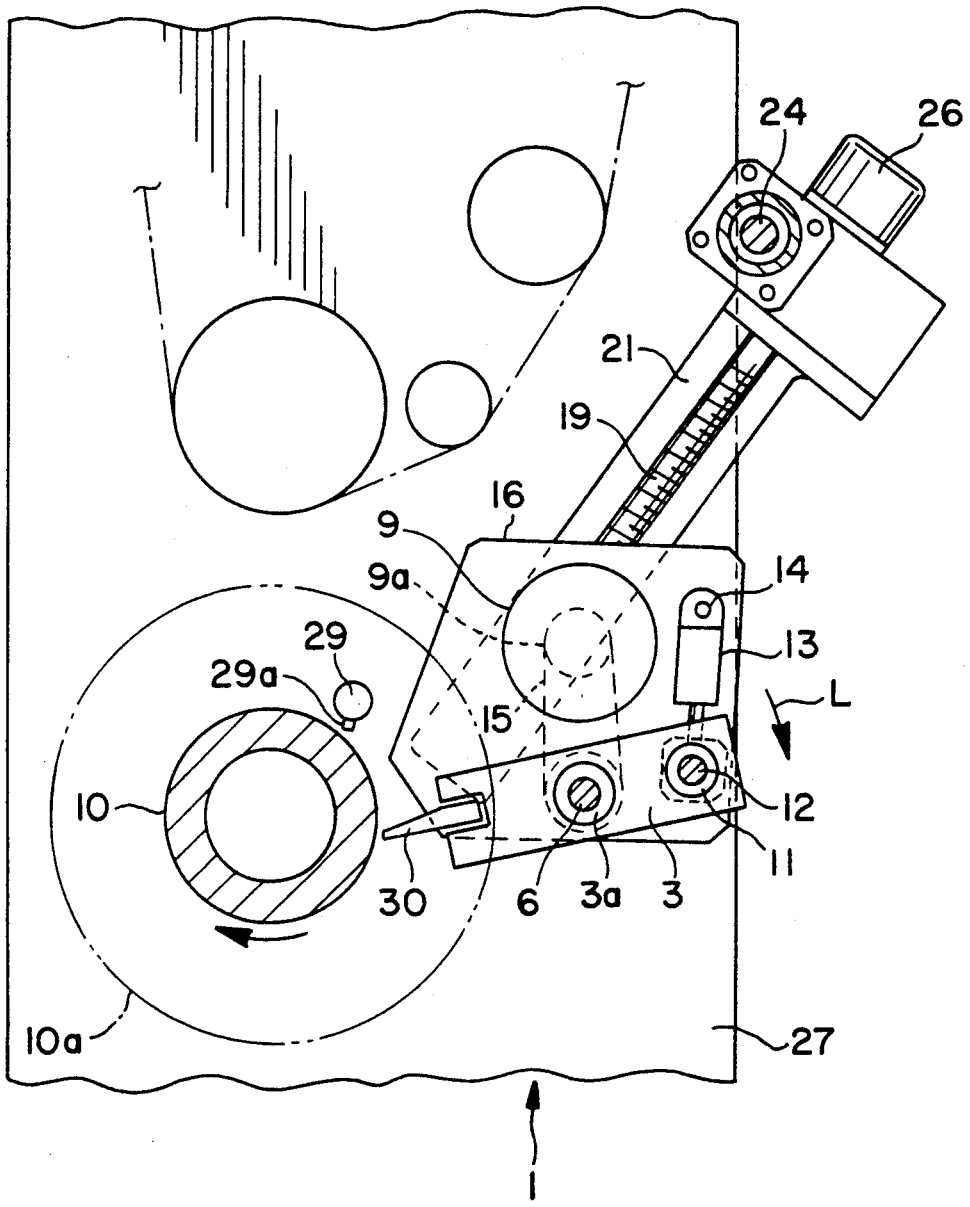
FIG. 2 is a cross sectional view taken along line II—II in FIG. 1.

In FIGS. 1 and 2, the automatic cleaning apparatus comprises a carriage 3 and a spatula 30 secured to one side of the carriage 3 and being capable of contacting an outer surface of a gravure plate cylinder 10. The carriage 3 has an internal thread portion 3*a* in the middle thereof. The internal thread portion 3*a* is engaged with an external thread of a screw bar 6. The screw bar 6 is arranged in a direction parallel to the gravure plate cylinder 10 and is rotatably supported by a pair of bearings 7, 7 at its two end portions. A sprocket 8 is secured to one end of the screw bar 6 and is rotated by the rotor shaft 9*a* of a motor 9 through a chain 15. The internal thread portion 3*a* has a ball screw (not shown) therewithin in order to reduce frictional resistance with the screw bar 6.

The bearings 7, 7 are respectively fixed to a pair of brackets 16, to one of which the motor 9 is also fixed. Each bracket 16 has an internal thread portion 16*a* secured thereto and is engaged with a feed screw 19. A pair of automatic changing controllers (not shown) are provided respectively at the two ends of the screw bar 6 so as to automatically detect the strike ends of the carriage 3 and control the normal and reverse rotations of the motor 9.

A bearing 11 is provided on the other side of the carriage 3 (the side opposite to the spatula 30). A pressure shaft 12 passing through the bearing 11, is arranged in a direction parallel to the gravure plate cylinder 10. Each end of the pressure shaft 12 is rotatably connected to an end 13*a* of an actuator 13. The other end 13*b* of each actuator 13 is pivotally connected to the corresponding bracket 16 through a hinged pin 14. That is, as shown in FIG. 2, the carriage 3 is swung about the screw bar 6 by the pressure shaft 12 when the actuator 12 is extended and contracted.

The internal thread portion 3*a* of the carriage 3 and the rotating screw bar 6 engaged with the internal thread portion 3*a* mentioned above constitute moving means for moving the carriage 3 in a direction parallel to the axis of the gravure plate cylinder 10. The bearing 11 of the carriage 3, the pressure shaft 12 passing through the bearing 11 and the actuators 13, 13 connected to the two ends of the pressure shaft 12 mentioned above constitute pressing means for pressing the spatula 30 of the carriage 3 against the gravure plate cylinder 10.

The pair of feed screws 19 engaged with the internal thread portions 16*a* of the brackets 16 are disposed near the opposite ends of the gravure plate cylinder 10 in an inclined direction so as to cope with the cylinders 10 having a larger diameter or a smaller diameter, as shown in FIG. 2. The pair of feed screws 19 are rotatably supported at the upper and lower ends thereof by bearings 20 fixed to bases 21. The bases 21 are parallel to the feed screws 19 and secured to a basic frame 27. The pair of feed screws 19 have worm wheels 22 secured to the upper ends thereof. The worm wheels 22 are engaged with worm portions 24*a* of a worm shaft 24 which is rotated by a motor 25 fixed to the basic frame 27. That is, the pair of feed screws 19, 19 are synchronously rotated by rotating the worm shaft 24. In FIG. 1, the feed screw 19 on the left side is shown without the worm shaft 24 for the sake of convenience.

A rotary encoder 26 for detecting the rotation of the feed screw 19 is provided at the upper end of the feed screw 19 on the right side (in FIG. 1). The rotary encoder 26 detects the rotation of the feed screw 19 and stops the motor 25 when the feed screw 19 has been rotated by a predetermined number of revolutions so that the brackets 16, 16 are positioned in place with respect to the gravure plate cylinder 10.

As shown in FIG. 2, a solvent sprinkling pipe 29 is arranged above and in a direction parallel to the gravure plate cylinder 10. The solvent sprinkling pipe 29 is used for sprinkling a cleaning solvent on the outer surface of the gravure plate cylinder 10 through nozzles **29*a* of the pipe 29. The solvent sprinkling pipe 29** sprinkles the solvent at substantially the same pressure as atmospheric pressure.

The operation of the automatic cleaning apparatus for gravure plate cylinders of the present invention is as follows.

First, the pair of feed screws 19, 19 are synchronously rotated by operating the motor 25 through the worm shaft 24, the worm portions and the worm wheels 22. In this case, the brackets 16, 16 are lowered by rotating the feed screws 19, 19 synchronously. When the feed screws 19, 19 have been rotated through the predetermined number of revolutions and the brackets 16, 16 are positioned in appropriate place with respect to the gravure plate cylinder 10, the rotary encoder 26 detects the predetermined number of revolutions of the feed screw 19 and stops the motor 25.

During this time, the gravure plate cylinder 10 is being rotated by driving mechanism 106, and a doctor (not shown) is pressed against the gravure plate cylinder 10. Next, an ink pan (not shown) is lowered, so that the surface of the ink in the ink pan is lower than the lowest part of the gravure plate cylinder 10. Thereafter, the ink remaining on the gravure plate cylinder 10 is scraped off in advance by the doctor. Next, the doctor is separated from the gravure plate cylinder 10, and the cleaning solvent is sprinkled on the gravure plate cylinder 10 through the nozzles of the solvent sprinkling pipe 29.

Next, the actuator 13, 13 are extended and the carriage 3 is swung about the screw bar 6 by the pressure shaft 12 (in a direction of the arrow L in FIG. 2), so that the spatula 30 supported by the carriage 3 is pressed against the gravure plate cylinder 10 in such a manner that the spatula 30 is positioned in a slightly inclined direction relative thereto. At the same time, the motor 9 is operated, and the screw bar 6 is rotated through the rotary shaft **9*a* and the chain 15, whereby the carriage 3 is moved in the direction parallel to the gravure plate cylinder 10. During this operation, the gravure plate cylinder 10 is rotated by driving mechanism 106**.

In this case, the ink remaining on the surface of the gravure plate cylinder 10 is dissolved by the cleaning solvent and scraped off by the spatula 30. In this way, the operation of cleaning the gravure plate cylinder 10 is performed.

As shown in FIG. 2, in the case where a gravure plate cylinder **10*a* having a different diameter from that of the gravure plate cylinder 10, the brackets 16, 16 are moved in the substantially diametrical direction of the gravure plate cylinder 10 by rotating the feed screws 19, 19 so that the brackets 16, 16 are positioned in place with respect to the gravure plate cylinder 10*a*. Therefore, the surface of the gravure plate cylinder 10*a* is positively cleaned by pressing the spatula 30 against the surface of the gravure plate cylinder 10*a***.

According to the automatic cleaning apparatus of the present invention, the ink remaining on the rotating gravure plate cylinder 10 is scraped off, and the surface thereof is cleaned by sprinkling the solvent in advance, pressing the spatula 30 supported by the carriage 3 against the gravure plate cylinder 10, and moving the carriage 3 in the direction parallel to the gravure plate cylinder 10 by the rotating screw bar 6.

As described above, the gravure plate cylinder 10 can be cleaned automatically. Therefore, the labor and the work time involved are greatly reduced, and improvement of working safety and hygiene is achieved.

What is claimed is:

1. An automatic cleaning apparatus for gravure plate cylinders comprising:

a carriage having a spatula capable of being placed in contact with the outer cylindrical surface of a gravure plate cylinder supported to be rotatable about the cylindrical axis thereof;

means for rotating the gravure plate cylinder;

moving means for moving the carriage in a direction parallel to the cylindrical axis of the gravure plate cylinder, said moving means comprising a rotatable screw bar extending parallelly to the cylindrical axis of the gravure plate cylinder and engaged with an internal threaded portion provided in the middle of the carriage;

a pair of brackets supporting said screw bar, each of said brackets screw brackets further including an internal threaded portion;

a pair of feed screws threadingly engaging with said threaded portion of said brackets and provided in a substantially diametrical direction of the gravure plate cylinder on which said pair of brackets is moved along;

pressing means for pressing the spatula against the outer cylindrical surface of the gravure plate cylinder, the pressing means comprising a pressure shaft passing through a bearing of the carriage on the opposite side to the spatula and an actuator connected to the pressure shaft, said pressure shaft further being secured to said brackets by said actuator whereby the spatula is pressed against or separated from the gravure plate cylinder by the actuator; and sprinkling means for sprinkling a cleaning solvent on the cylindrical surface of the gravure plate cylinder, the sprinkling means comprising a solvent sprinkling pipe disposed parallelly to and above the gravure plate cylinder, the solvent sprinkling pipe sprinkling solvent at substantially atmospheric pressure.

* * * * *